US005359833A

United States Patent [19]

Gronskov

[11] Patent Number: 5,359,833

[45] Date of Patent: Nov. 1, 1994

[54] METHOD OF DEPOSITING EXTRUDED PIECES OF SUBSTANCES ONTO INDIVIDUAL WRAPPING SHEETS AND APPARATUS FOR CARRYING OUT THE METHOD

[75] Inventor: Per Gronskov, Frederiksberg C., Denmark

[73] Assignee: Gerstenberg & Agger, A/S, Frederiksberg C., Denmark

[21] Appl. No.: 969,230

[22] PCT Filed: Aug. 13, 1991

[86] PCT No.: PCT/DK91/00229

§ 371 Date: Feb. 10, 1993

§ 102(e) Date: Feb. 10, 1993

[87] PCT Pub. No.: WO92/03340

PCT Pub. Date: Mar. 5, 1992

[30] Foreign Application Priority Data

Aug. 14, 1990 [DK] Denmark ..... 1927/90

[51] Int. Cl.[5] ..... B65B 11/08; B65B 25/06; B65B 39/14; B65B 35/10

[52] U.S. Cl. ..... 53/435; 53/209; 53/519

[58] Field of Search ..... 53/435, 519, 518, 516, 53/514, 513, 209

[56] References Cited

U.S. PATENT DOCUMENTS

| | | | |
|---|---|---|---|
| 813,375 | 2/1906 | Glauser | 53/518 X |
| 2,023,122 | 12/1935 | Chandler | 53/519 |
| 2,529,850 | 11/1950 | Scharsch | 53/519 |
| 4,094,122 | 6/1978 | Edmunds, Jr. | 53/209 X |

FOREIGN PATENT DOCUMENTS

| | | | |
|---|---|---|---|
| 1388235 | 3/1975 | United Kingdom | 53/519 |

*Primary Examiner*—James F. Coan
*Attorney, Agent, or Firm*—Watson, Cole, Grindle & Watson

[57] ABSTRACT

A method of cutting pieces of an extruded substance and depositing the pieces on individual wrapping sheets which are being conveyed in the same direction and at the same velocity as the extruded substance is disclosed. The wrapping sheets are fed in an overlapped fashion to the point where the cut off extruded piece is placed onto a wrapping sheet and the conveyor under the sheet onto which the cut piece is being placed is accelerated so that the sheet is disengaged from the overlap with the succeeding sheet immediately before the next cut piece is to be placed onto the next following sheet. An apparatus is disclosed with means necessary for carrying out the method.

9 Claims, 4 Drawing Sheets

METHOD OF DEPOSITING EXTRUDED PIECES OF SUBSTANCES ONTO INDIVIDUAL WRAPPING SHEETS AND APPARATUS FOR CARRYING OUT THE METHOD

BACKGROUND OF THE INVENTION

1. Field of the Invention

The present invention relates to a method of cutting pieces of an extruded substance and depositing such pieces on separate wrapping sheets.

2. The Prior Art

In certain prior art methods of the above mentioned-type the pieces are removed as they are cut from the extruded string of substance and conveyed by means of separate displacement devices or the like to be deposited on separate wrapping sheets. The result of such handling of the pieces is that the string of substance cannot be extruded continuously.

Another prior art method is disclosed in U.S. Pat. No. 4,094,122 according to which the cut pieces of substances continously are deposited directly onto separate wrapping sheets, so that the transfer operations and displacement devices required for such transfer are avoided. This is achieved by placing the leading end of the substance being extruded directly onto the wrapping sheet conveyed by the conveyors a sufficient distance from the leading edge of the wrapping sheet to allow the protruding leading edge of the sheet to form a front end closure of the finished package, advancing the trailing edge of the wrapping sheet and the leading edge of a succeeding wrapping sheet in a manner so that they form a mutual overlap of a size which is at least sufficient to form a rear end and a front end closure in the respective finished pre-packages, and then by accelerating the leading wrapping sheet together with the cut piece of substance thereon in relation to the extruding velocity of the substance.

As a result, it is possible to extrude the substance and convey the sheets continuously, as the cut surfaces formed by cutting the individual pieces of substance are moved away from each other. Thus, the leading ends and the succeeding trailing ends of the wrapping sheets are kept clear of extruded substance and the sheets, each having a piece of substances deposited thereon, are conveyed to a subsequent mechanism for wrapping the single sheet around the pertaining piece of substances and for folding the front and rear end closures. Moreover, the substance is handled gently as the pieces need no further handling when deposited onto the sheets.

However, as far as production is concerned, the invention according to U.S. Pat. No. 4,094,122 suffers from certain restrictive drawbacks. Thus, the extruded pieces of substances are cut on the basis of a flow measurement, i.e. a measurement of volume, performed within the extruder proper before the product leaves the extruder, which naturally results in a certain inaccuracy in the size of the measured pieces of substances, because the measuring signal controlling the cutter allows movements in the extruded mass between the point of measurement and the point of cutting which is located a certain distance outside the mouth of the extruder. Furthermore, the cut is performed against a solid base on the conveyor belt at a time when the extruded substance is placed upon the overlap of two consecutive wrapping sheets. As the wrapping sheet with the cut piece of substance thereon has to be accelerated immediately after the cut has been made to separate it from the succeeding underlapping sheet, the invention according to U.S. Pat. No. 4,094,122 has clear physical limits as to how much a piece of substance may weigh in order to make it possible to accelerate and separate the two sheets in question, as blocks of extruded substance may cause such friction between the overlapping wrapping sheets due to the weight proper of the substance that in practice the machine cannot produce the acceleration pull required to separate the sheets. Indeed, it also appears clearly from U.S. Pat. No. 4,090,122 that the invention particularly concerns cutting, conveying and wrapping extruded pieces of substances of a very small height with an equal small weight, so that the above-mentioned drawbacks will have relatively little significance.

SUMMARY OF THE INVENTION

Therefore, it is the object of the present invention to provide a method and an apparatus for cutting and depositing extruded pieces of substances onto wrapping sheets during the continuous conveyance of the latter, the sheets being initially conveyed at a velocity corresponding to the extruding velocity and subsequently accelerated, and the leading edge of a cut piece of substance being deposited only onto that part of a wrapping sheet which does not overlap the succeeding sheet so that the overlapping portion proper between two sheets is not changed with the weight from a piece of substance during the overlap relieving sequence of the apparatus, thus facilitating this sequence and making it possible to extrude and wrap pieces of substances having a very high relative netweight and a great relative height.

The invention will now be explained in further detail with reference to the drawing.

DETAILED DESCRIPTION OF THE PREFERRED EMBODIMENT

Figure 1:
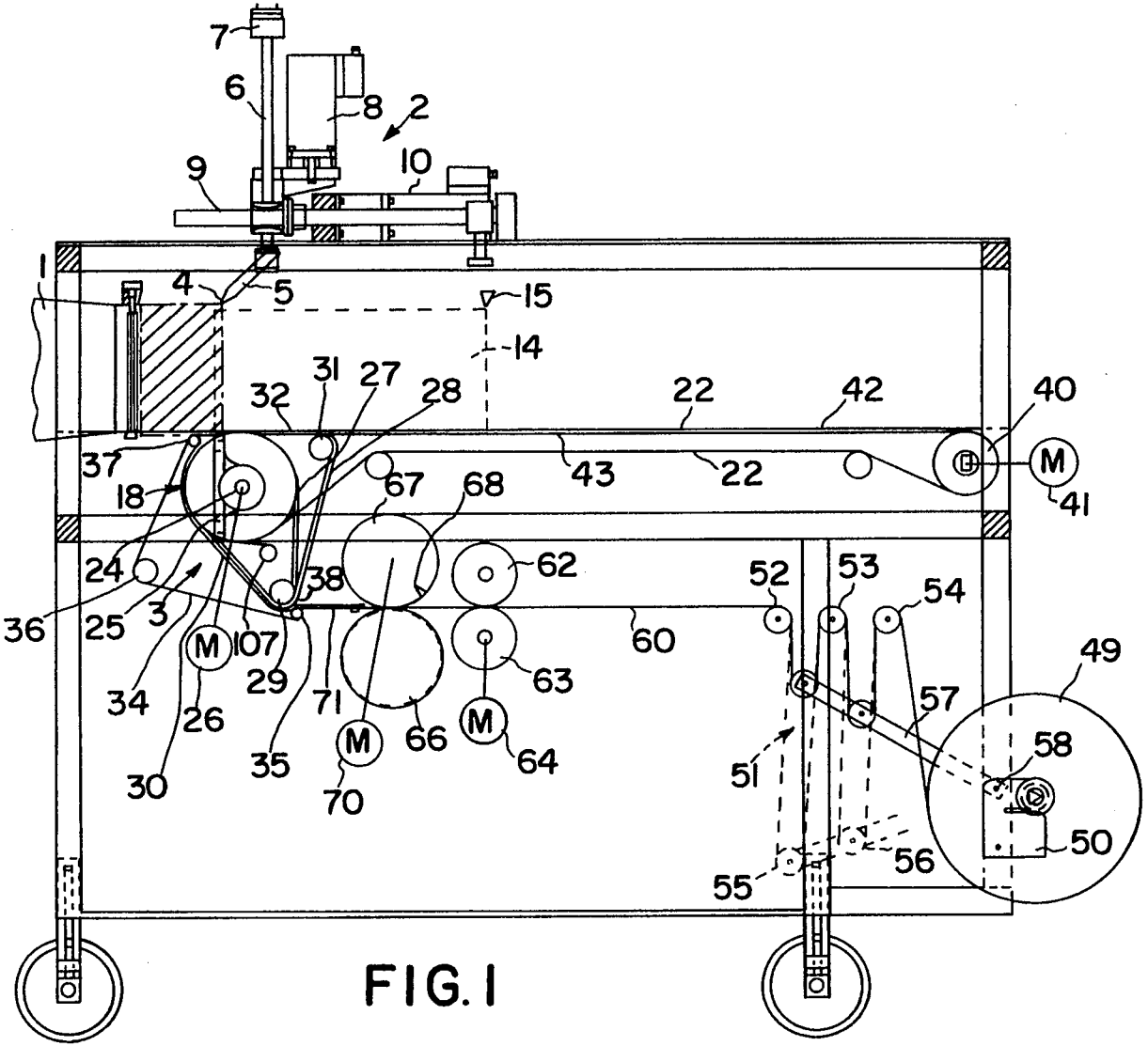
FIG. 1 shows a partially vertical sectional side view of an embodiment of the apparatus for carrying out the method according to the invention.

In the drawing reference numeral 1 indicates the head of an extruder for extruding a relatively pliable substance, e.g., butter, margarine, cooking fat, or the like. The reference numeral 2 indicates a cutting mechanism for cutting pieces of the extruded substance, and 3 indicates the conveyor means for feeding wrapping sheet, e.g. paper, to the zone in proximity to the discharge end of the head 1.

The cutting mechanism 2 comprises a cutter in the form of an electrically-heated thread 4 extended between two arms 5, of which only the distal one is visible in FIG. 1. These arms 5 are attached to the lowermost end of each leg 6 of a bridge 7. Seen in the vertical direction, the arms 5 and the legs 6 have a length which is greater than the greatest height of the strings of substance which are extruded from the head 1, the distance between the legs 6 being wider than the greatest width of the strings of substance which are extruded. It will be understood that the head 1 can be provided with different extruding mouth pieces depending on the size of the string of substance to be extruded.

The bridge 7 is connected to means in the form of a servomotor 8, by means of which the thread 4 can be moved upwards and downwards. The bridge 7 and the servomotor 8 are supported by a shaft 9 extending in the direction of extrusion and connected to means in the form of another servomotor 10, by means of which the thread 4 can be moved forwards and backwards parallel to the direction of extrusion.

In FIG. 1 the thread 4 has performed an upward movement, thereby causing a piece of substance 14 to be cut. In order to be ready for the next cut the thread 4 is moved to the left in a distance corresponding to the extruding velocity multiplied by the duration of time of a cut. When the next cut is to take place, the servomotors 8, 10 are started by an impulse from a sensor 15 which emits the impulse when the piece of substance 14 has obtained the desired predetermined length. As a result, the thread 4 is moved to the right at the speed of the extruding velocity and at the same time the thread 4 is moved downwards at a velocity which is selected so that the cut has just taken place when the thread 4 has travelled the same distance to the right as it was moved earlier to the left. The movement of the thread 4 is now repeated opposite the extruding direction and over the same interval as previously, but this time underneath the extruded substance, and the thread 4 is moved upwards when the next impulse is emitted by the sensor 15. The two absolute movements performed by the thread (i.e. as seen in the space) ere indicated with dotted lines 16 and 17 in FIG. 3, in which the downward and the upward absolute movements are indicated with 16 and 17, respectively. The sensor 15 may, e.g., be an analog or digital touch-free distance meter of a known type which is adjustable to the desired length of the pieces of substances to be cut and which is capable of measuring such pieces of substances with an accuracy of ±0.01% of the length of the single piece, just as the servomotors 8 and 10 are adjustable in accordance with any current extruding velocity and the height and the width of the desired piece of substance. Furthermore, the sensor 15 is mounted in a known way outside the mouth of the extruder 1 at a variable, but known horizontal distance .of the latter and in such a manner that the sensor 15 follows the movements of thread of the cutter 4 and measures the desired length of the pieces of substance 14 and controls the positioning of the thread during its cutting of the pieces.

Figure 2:
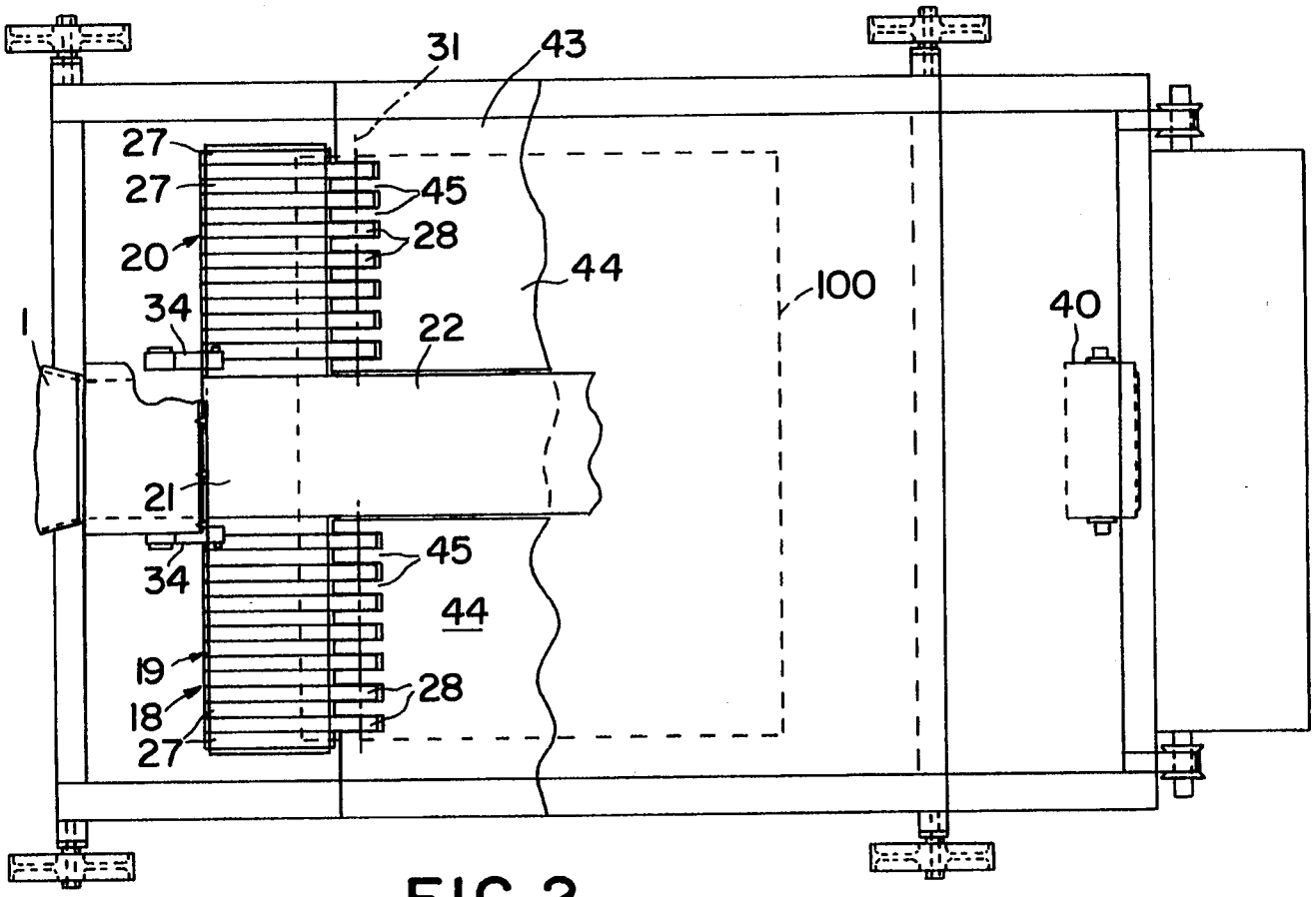
FIG. 2 shows a top view of the apparatus shown in FIG. 1, but in which certain parts are removed for reasons of clarity.

The conveyor means 3 comprises a drum mechanism 18 consisting of three drum parts, viz. two end parts 19 and 20 and a middle part 21 mounted between them, which middle part is covered in FIG. 2 by an endless conveyor belt 22 known per se. The drum end parts 19 and 20 are mounted non-pivotally on a shaft 24 which is pitovally mounted in bearings 25, one of the bearings being secured at each side of the apparatus. The middle part 21 of the drum is mounted freely pivotally on the shaft 24 which is connected to a drive motor 26 in a non specified way. Several circular grooves having toothed bottoms are provided in each end part of the drum, and a corresponding toothed belt engages with every second of the grooves. In the example shown there are eight belts 27 for each end part 19, 20 of the drum. The back of each belt 27 has a high coefficient of friction in relation to the wrapping material used and protrudes slightly from the pertaining groove. A toothed belt 28 engages with each of the interjacent grooves and each end part of the drum has seven toothed belts. The back of each belt 28 has a small coefficient of friction in relation to the wrapping material used and protrudes slightly from the pertaining groove. All the belts 27 and 28 run around a guide roll 29 which is pivotally mounted at each side of the apparatus. The guide roll 29 is located under the drum mechanism 18 and slightly displaced to the right so that the belts 27 and 28 form an inclined track 30 running upwardly to the left between the guide roll 29 and the end parts of the drum.

Furthermore, the smooth belts 28 are carried around another guide roll 31 which is located in such a manner that the belts have a horizontal track 32 which is substantially flush with the bottom side of the extrusion opening of the extrusion head 1.

The conveyor means 3 furthermore include two endless holding belts 34, 34 which have relatively smooth exterior surfaces, and each of these belts runs around three guide rolls 35, 36, 37 which are pitovally mounted in the frame of the apparatus so that along a part of the guide rolls the exterior surfaces of the holding belts are pushed in a direction towards the exterior surfaces of the belts 27 and 28 along the track 30 of the belts and along a part of the belts 27 and 28 engaging with the end parts 19, 20 of the drum. Furthermore, the belts 34, 34 are pushed towards the belts 27 and 28 along a part of the periphery of the roll 29, the rolls 35 being located under and slightly to the right of the roll 29. At the same time, the rolls 29 and 35 cause a sheet feed opening 38 to be formed between the belts 34,34 on the one side and the belts 27 and 28 on the other side. The belts 34 are adjusted transversely to the apparatus by way of known means (which are therefore not shown).

The tensions on the belts 27, 28 and 34 are adjusted in a manner known per se by means of tightening means (not shown).

The endless conveyor belt 22 runs around the middle part 21 of the drum which also functions as an end return roll of the belt 22. The second end return roll 40 of the belt 22 is pivotally mounted at the opposite end of the apparatus (as seen in relation to the position of the extruder) and is connected to a motor 41 in a manner not further indicated. The roll 40 is located in such a manner that a substantially horizontal track is formed between the roll and the middle part 21 of the drum, this track being substantially flush with the bottom side of the extrusion opening of the extrusion head.

A support plate 43, see FIG. 2, is located under the track 42. In the lateral direction the plate has protruding portions 44,44 which are toothed at their front edges to form teeth 45. These teeth project into the spaces between the belts 28 which are carried around the guide roll 31 (only the axis of the roll being shown in FIG. 2), and the outer ends of the teeth 45 are beaded slightly downwards towards the exterior surfaces of the end parts 19, 20 of the drum. The middle part of the support plate extending below the belt 22 is slightly submerged in relation to the side portions 44 and extends to the middle part 21 of the drum and ends in a sharp edge 47, FIG. 3.

The material to be used for wrapping the extruded pieces of substances is mounted in the form of a roll 49 at the right end of the apparatus of FIG. 1 in a known manner. The roll 49 is pitovally mounted in two consoles, one of the consoles being shown in FIG. 1. The apparatus is provided with a buffer or accumulator which in general has the reference numeral 51 and which consists of three guide rolls 52, 53 and 54, these guide rolls being pivotally mounted but otherwise unmovably placed, and two rolls 55 and 56 which at their ends are pivotally mounted in two swinging arms 57, one of the arms being visible in FIG. 1. These arms are pivotally connected to the consoles 50 by means of bearings 50, of which only one is visible in FIG. 1. The buffer 51 serves to relieve the roll 49 of sudden pulls in the web of material 60 which is removed from the roll 49.

A pair of conveyor rollers 62,63 is mounted between the buffer 51 and the feed opening 38 between the rolls 29 and 35, viz. one pair of conveyor rollers is mounted above and one is mounted below the web 60. The bottom rollers 63 are connnected to a motor 64 in a manner not further indicated. A pair of rotating scissors are mounted between the rollers 62, 63 and the feed opening 38, the scissors having the form of a counter drum 66 having a smooth surface and a cutter drum 67 located above the former. The exterior surface of the cutter drum is provided with a longitudinal groove in which a cutter 68 is mounted. The drum 67 is connected to a drive motor 70 in a manner not further indicated. A sheet overlapping mechanism 71 is mounted between the rotating scissors 66,67 and the sheet feed opening 38.

Figure 3:
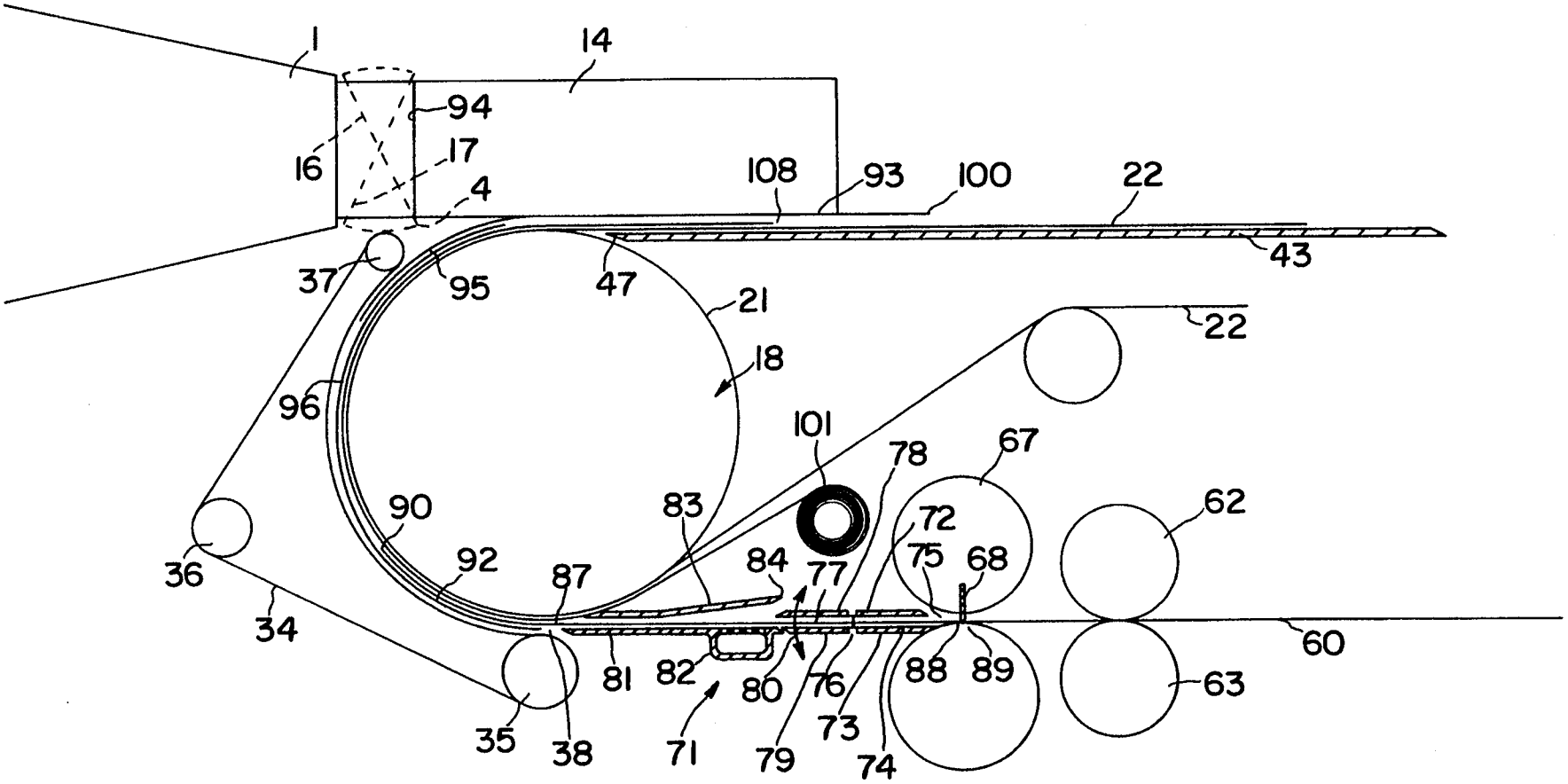
FIG. 3 shows a sectional view of an amended embodiment of the apparatus according to FIG. 1 along the line III—III in FIG. 4, but in which certain parts of the apparatus are omitted.

The sheet overlapping mechanism 71 appears more clearly from FIG. 3. As mentioned above, FIGS. 3 and 4 show an amended embodiment of the apparatus shown in FIGS. 1 and 2. The only fundamental difference is that in the amended embodiment according to FIGS. 3 and 4 the guide roll 29 of the belts 27 and 28 is omitted. The belts 28 still run around a second guide roll 31 so that the track 32 is maintained. The friction belts 27 are in the form of rings which have toothed inner sides engaging with the teeth in the bottoms of the pertaining grooves. For reasons of clarity the belts 27 and 28 are omitted in FIGS. 3 and 4. Thus, the belt track 30 is not used in the amended embodiment and the bottom guide rolls 35 of the holding belts 34 are located immediately below the drum mechanism 18 so that the sheet feed opening 38 is formed between the drum mechanism and the guide rolls 35.

The sheet overlapping mechanism, which is known in principle, is the same in the two embodiments and is clearly shown in FIG. 3 and consists of a track guide having an upper plate 72 and a lower plate 73 forming a low track guide channel 74 between them which extends in the entire length of the scissors 66, 67 and has its one end extending towards the gap 75 of the scissors, A channel part 77 also formed between the upper plate 78 and the lower plate 79 is hinged (at 76) to the edges of the plates 72 and 73 facing away from the gap 75. The channel part 77 is pivotable by way of means (not shown) around the hinge 76 as indicated with a double arrow 80, The channel part 77 is succeeded by a support plate 81 at the front end of which a suction box 82 is located and the rear end of which extends to the sheet feed opening 38. An feed plate 83 having its leading edge (inlet edge) bended upwards in relation to the support plate 81 is located above the support plate 81 to receive the leading edge of the wrapping sheet when the sheet leaves the channel part 77.

The sheet overlapping mechanism 71 operates in the following way:

For each rotation performed by the cutter drum 67 a cut is formed transversely to the entire web 60 and a sheet is cut free. The trailing edge 88 of the sheet and the leading edge 89 of the web are introduced into the track guide channel 74, as the leading edge 90 of the free cut sheet 87 being already introduced into the sheet feed opening 38 and being in engagement between the exterior surfaces of the friction belts 27 and the exterior faces of the belt holders 34. However, the leading edge 89 of the web 60 is advanced by the conveyor rollers 62, 63. During the passage of the cut through the channel part 78, the channel is turned upwards and when leaving the channel the trailing edge 88 will be drawn downwards by the suction box 82 and cover the box. Consequently the leading edge 89 of the web 60 will move down under the feed plate 83 in a certain distance above the trailing edge 88. The conveyor rollers 62, 63 are now accelerated by their motor 64, thereby causing the leading end of the web 60 to overlap the trailing end of the sheet 87. In FIG. 3 the reference numeral 92 indicates the overlap formed by the preceding overlapping operation. Thus, the acceleration of the conveyor rollers is adjusted so that the overlap is provided before the leading edge 89 of the web reaches the sheet feed opening 38 and has obtained a width corresponding to at least twice the length of the sheet necessary to form an end closure of the final pre-package. Once the sheets have overlapped, the conveyor rollers 62, 63 are decelerated to their earlier velocity corresponding to the extruding velocity.

The mode of operation of the two hitherto mentioned apparatuses being alike as to extrusion, cutting of pieces and deposition of the pieces onto the sheets, these parts of the operation will now be described with reference to FIGS. 3 and 4.

When the thread 4 has finished the cutting immediately outside the mouth end of the extruder 1 and the leading end of the piece of substance 14 has been placed on the leading part, of the pertaining sheet 93 and the trailing end of the piece of substance still is located in a certain distance above the trailing part of the sheet 93, the piece of substance 14 is released from the substance string and partly placed upon the sheet 93 conveyed to the right in FIG. 3 by the conveyor belt 22 running continuously at a far greater velocity than the extruding velocity.

Thereby, the piece of substance 14 and the pertaining sheet 93 are removed from the succeeding piece of substance on the succeeding sheet 96 before the piece 14 comes fully to rest on the sheet 93, the sheet 96 thus no longer being overlapped by a portion of the sheet 93.

The extruder works continuously and the drum end parts 19 and 20 are likewise driven continuously and in a manner so that, in relation to the protruding surfaces of the belts 27, they run with great friction and at the same velocity as the extruding velocity.

As will appear from FIG. 3, the cut surface 94 just formed at the end of the cut string of substance is located substantially immediately above the middle of the portion 95 of the succeeding sheet 96 which was overlapped earlier by the trailing end part of the sheet 93 which is now removed as mentioned above. Consequently the end surface (the cut surface 94) of the piece of substance will be placed along the transverse center line of the sheet portion 95, and as a result a free leading edge zone is formed on the sheet 96, said zone having a length corresponding to half the length of the overlapping part. The piece of substance on the sheet 96 will now be conveyed together while a new piece of substance 14 is being extruded, as the side portions of the sheet 96 protruding along the end parts 19 and 20 of the drum will be retained between the friction belts 27 and the holding belts 34, this retention exceeding the conveying effect, of the belt 22.

As the extrusion gradually progresses the retention of the sheet 96 by the friction belts 27 will gradually be reduced as an increasing portion of the sheet leaves the retention zone of the holding belts 34. The leading edge of the succeeding sheet will be lifted free of the friction belts by the teeth 45 and be conveyed to the side portions 44 of the support plate. For reasons of clarity the teeth are omitted in FIG. 4.

When a cut has been terminated, the conveying effect of the belt 22 exceeds the retention of the sheet caused by the smooth holding belts 34 pressing the trailing portion of the sheet down against the leading portion of the succedding sheet and by any remaining engagement with the friction belts 27 as well as by the engagement between the bottom side of the side portions of the wrapping sheet, which is not weighed down by the piece of substance, and the exterior surfaces of the portions of the smooth belts 28 forming the track 28 and which has not yet been overlapped by the leading part of the succeeding sheet. The frictional force exerted by the sheets in the overlapping zone is only very small. The retention effect caused by the pull strength of the string of substance is eliminated when the string of material is cut and hence the sheet 96 will be conveyed by belt 22 and will now be quickly removed to the right. The stage shown in FIG. 3, i.e., immediately before removal of sheet, is also shown in FIG. 4 in which the leading edge of the sheet, onto which a deposition of a piece of substance has just taken place, has the reference numeral 100, the side edges of the sheet 101 and 102 and the trailing edge 103 and the piece 14 is shown with dot-and-dash lines. The trailing edge of the succeeding sheet has the reference numeral 104.

Figure 4:
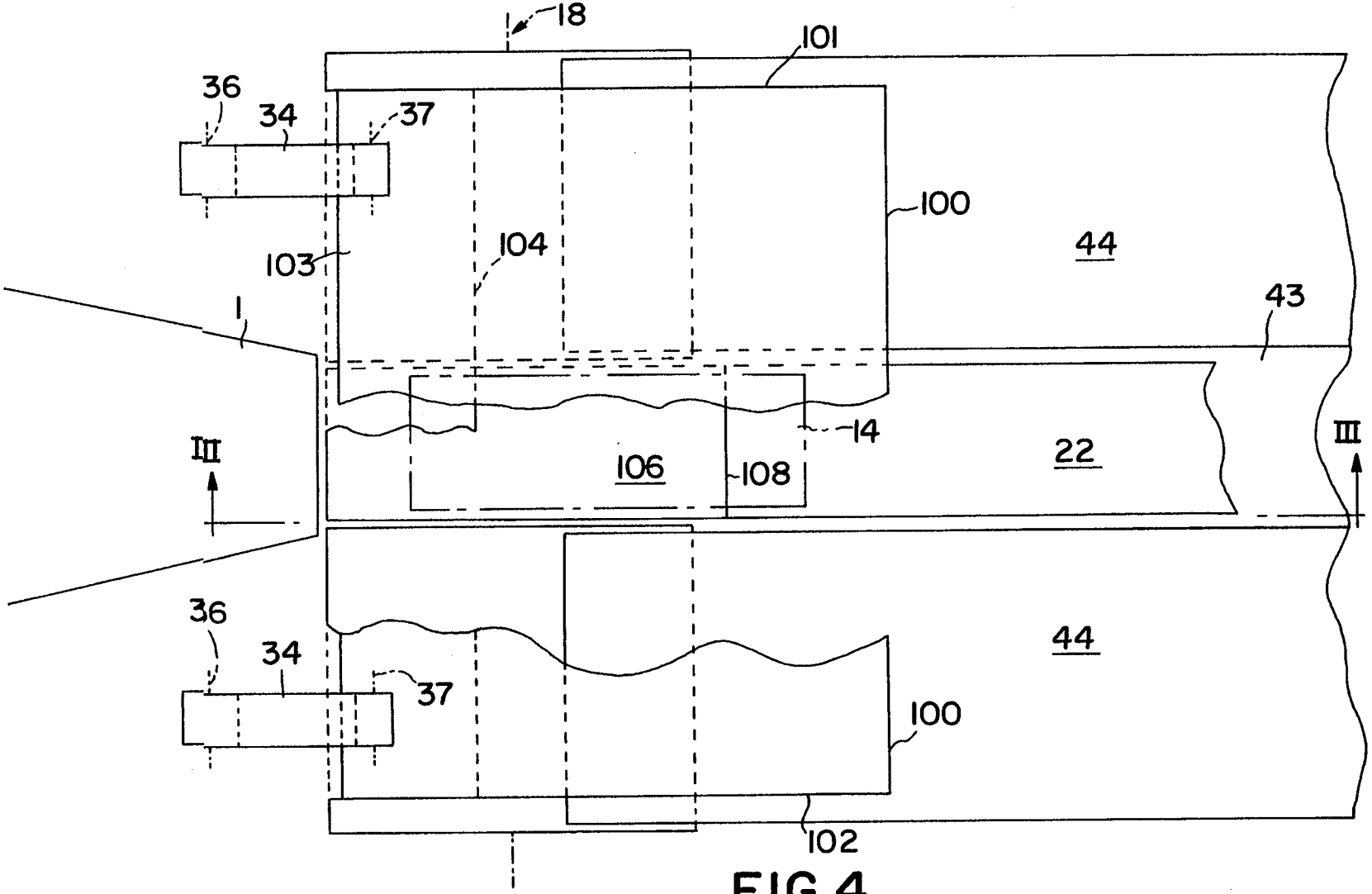
FIG. 4 shows a top view of the portion of the apparatus shown in FIG. 3.

For reasons of clarity the teeth 45 along the leading edge 106 of the side portions 44, 44 of the support plate 43 are not shown in FIG. 4 as mentioned above, but it will be understood that in both embodiments these teeth will result in that the leading edges of the sheets are effectively conveyed to the side portions 44, 44 of the support plate 43 and they are not carried downwards around the roll 31 by the smooth belts 28 running around the said roll.

The sheet, the contour lines of which are shown in FIG. 4 as 100, 101, 102 and 103, has a size which is the maximum for the apparatuses shown. Also the piece 14 is shown in the drawing with a maximum size.

However, the apparatus can readily be adjusted to other sheet sizes, piece sizes and dimensions of strings of substances, as the mouth piece of the extruder is interchangeable, and as the apparatus comprises an electronic calculation and control system (not shown) for regulating the velocity of the motors 8, 10, 26, 41, 64 and 70, which system also controls the accelerations and decelerations of the motor 64.

In order to avoid having to control the above mentioned adjustments of the frictional forces and the pull strength of the extruded string of substance within narrow limits, the apparatus is provided with a slide cloth 106 (FIG. 4) which in the embodiment shown has the same width as the belt 22. The cloth 106 is mounted on a roll 107 (FIG. 3) and the leading edge of an extended portion of the cloth has the reference numeral 108. As it clearly appears from FIGS. 3 and 4 the extended portion of the cloth 106 extends from the roll 107, around the middle part 21 of the drum and outside the acceleration belt 22 and ends at 108 as mentioned above. The cloth consists of a smooth material, e.g. Teflon-coated canvas, and prevents direct contact between the belt 22 and the portion of a sheet upon which a piece of substance 14 is extruded. The degree to which the cloth can prevent the contact can be adjusted by rolling out a larger or smaller length of cloth from the roll 107 in turning the latter. The leading edge 108 is loosely placed upon the belt 22, the roll 107 being checked against turning after adjustment. As the extrusion of substance gradually progresses, an increasing portion of the sheet will move past the edge 108 of the cloth and increasingly get into contact with the belt 22. Thus, the conveying effect exerted on the sheet by the belt 22 can be regulated, thereby facilitating balancing of the above mentioned applied forces.

Even though the above explanations relate to apparatuses in which the trailing edge of a sheet overlaps the leading edge of a succeeding sheet when the sheet is fed to the extruder, the reverse form of overlap may also be used, but in that case the holding belts 34 should have a high friction effect and the belts 27 a low friction effect. If so, the trailing portion of the sheet will be wedged between the smooth belts and the leading portion of the succeeding sheet when the sheet is accelerated just as in the embodiments shown. However, such an embodiment will involve a risk of smudging the leading portion of a succeeding sheet, as this portion will be the upper one nearest to the substance when the string of substance is cut.

It will be understood that the belt 22 is intended for conveying the sheets with the pieces of substances to a machine in which the sheets are wrapped around the pieces in a manner known per se and the end closures are formed, e.g. by folding.

I claim:

1. A method of cutting pieces from an extruded substance and depositing each cut piece into a pertaining wrapping sheet, comprising feeding each sheet to a position immediately below an extruder by a conveyor means in such a manner that a trailing edge of a sheet overlaps a leading edge of a succeeding sheet, placing a leading end of the piece of substance being extruded from a mouth of the extruder directly onto the wrapping sheet conveyed by the conveyor means and at a certain distance from the leading edge of the said wrapping sheet to enable the protruding leading edge part of the sheet to form a front end closure of the cut piece, advancing the trailing edge of the wrapping sheet and the leading edge of the succeeding wrapping sheet in a manner so that they have a mutual overlap having a length which is sufficient to form a rear end closure of the sheet and a front end closure of the succeeding sheet of the cut piece, and where the sheet and the cut piece of substance are then accelerated from said position with a velocity higher than the extruding velocity of the substance in order to separate the sheet with a piece of substance thereon from the overlapping pat of the succeeding sheet, wherein the extruded pieces of substances are cut immediately downstream of the mouth of an extruder such that the portion of a cut piece facing away from the mouth of the extruder is deposited onto the pertaining wrapping sheet on that part of the sheet which is not overlapping the succeeding sheet, whereas the portion of the extruded piece closest to the mouth of the extruder is still located at a certain distance above the sheet and then accelerate the sheet with said higher velocity to separate the sheet from the succeeding sheet before the said piece of substance as a whole is deposited onto the sheet and before the succeeding sheet is in a ready position in relation to the extruder to receive the succeeding extruded piece of substance.

2. An apparatus which comprises an extruder, a cutting mechanism comprising a cutter, means for causing the cutter to cut the extruded pieces of substances, conveyor means comprising feeding and cutting means and a paper overlapping mechanism for conveying, cutting and overlapping sheets of paper from a paper web to a receiving position for extruding pieces of substances in a track on the upper side of the conveyor means, and means for accelerating the sheet with the cut pieces of substances placed thereon with a velocity higher than the extruding velocity so that the sheets are relieved of the overlapping portion of the succeeding sheets, wherein the cutter of the cutting mechanism is mounted immediately outside the mouth of the extruder for cutting pieces of substances using no solid base for the cutting, and comprising means for making the cuts in subsequent, opposite directions downwards and upwards, respectively, and means for automatically moving the cutter in the same or in the opposition direction as the extruding direction between each unit and in dependence of a predetermined length of a piece of substance to be cut so as to place said piece of substance with its portion facing away from the mouth of the extruder on that part of the pertaining wrapping sheet which is not overlapping the succeeding sheet, and with its portion closest to the mouth of the extruder still located at a certain distance above said sheet, and comprising means for accelerating the sheet with the partly deposited piece of substance at said velocity higher than the extruding velocity so as to separate the sheet from the succeeding sheet before the piece of substance as a whole is deposited on the sheet.

3. An apparatus according to claim 2, wherein the cutter of the cutting mechanism comprises an electrically heated cutting thread.

4. An apparatus according to claim 2, including a sensor for directing the electrically heated cutting thread of the cutter in dependence of the predetermined length of the piece of substance, the sensor being a contact free distance meter.

5. An apparatus according to claim 4, wherein the sensor is mounted outside the mouth of the extruder and with a variable, known distance in the horizontal plane between the sensor and the extruder in the direction of extrusion thereby allowing the sensor to measure the desired length of the piece of substance before being cut by the cutter.

6. An apparatus according to claim 2, wherein the conveyor means includes a drum mechanism located below the extruder, said drum mechanism comprising two end parts and a middle part, which end parts are connected to a shaft and the middle part is pivotably mounted in relation to said shaft, the end parts comprising circular grooves, some of these grooves holding at least a part of a belt so that the belts have protruding portions in relation to the grooves, which portions have a high coefficient of friction in relation to the wrapping sheets, other grooves holding other belts having protruding portions with a low coefficient of friction, and the friction belts comprise a pair of smooth holding belts comprising means for pushing the holding belts against the friction belts, and the drum end parts rotate at such a velocity that the surfaces of the friction belts are moved at the same velocity as the extruding velocity, and the apparatus comprises an acceleration belt running around the middle part of the drum.

7. An apparatus according to claim 6, wherein the smooth belts form a track running parallel with the direction of extrusion.

8. An apparatus according to claim 6, wherein the acceleration belt is supported by a support plate having protruding side portions along the sides of the acceleration belt, the front edge of the side portions having teeth which engage between the friction belts forming the track.

9. An apparatus according to claim 6, including a slide cloth of a smooth material, an adjustable portion of which is placed upon the acceleration belt.

* * * * *